US006075440A

United States Patent [19]

Carroll

[11] Patent Number: 6,075,440

[45] Date of Patent: Jun. 13, 2000

[54] WINDOW MOUNTED MOTION DETECTER

[76] Inventor: Robert T. Carroll, 378 Friendship Rd., Robeline, La. 71469

[21] Appl. No.: 09/313,622

[22] Filed: May 18, 1999

[51] Int. Cl.[7] ..... G08B 13/08

[52] U.S. Cl. ..... 340/546; 340/545.1; 340/541; 200/61.73

[58] Field of Search ..... 340/541, 545.1, 340/545.2, 545.7, 545.8, 546, 693.5; 200/61.71, 61.73, 61.76, 61.81, 61.93

[56] References Cited

U.S. PATENT DOCUMENTS 4,553,134 11/1985 Holt ..... 340/545.1
4,837,557 6/1989 Striebel ..... 340/546
4,888,578 12/1989 Conemac ..... 340/546
4,896,139 1/1990 Eldridge ..... 340/546
5,166,665 11/1992 McCarthy ..... 340/546
5,872,514 2/1999 Neas ..... 340/545.1

*Primary Examiner*—Jeffery A. Hofsass
*Assistant Examiner*—Van T. Trieu
*Attorney, Agent, or Firm*—Rodney Bryant Jordan

[57] ABSTRACT

A window mounted motion detector comprising a motion detector equipped with an upper and lower rod so that the assembly can be used to prop open a window sash and to detect potential intruders approaching the window.

6 Claims, 3 Drawing Sheets

WINDOW MOUNTED MOTION DETECTER

BACKGROUND OF THE INVENTION

The invention described herein relates to a mechanism for enhancing the security of someone's home. As crime increases the necessity for individuals to protect their possessions and families from intruders is becoming a more urgent and difficult concern. The invention as described herein will provide a valuable new weapon in the pursuit of the safest possible home.

DESCRIPTION OF THE PRIOR ART

Motion detectors have been in use for several years. Although they are excellent devices for detecting movement they have been limited in their use because of their lack of an appropriate mounting device. Their use was limited to those inside areas where the presence of an intruder already exists. Often the damage is already done or inevitable, especially in matters of personal safety. When installed outside motion detectors often sense movement that is normal and of no concern to the home owner. This results in numerous false alarms and actually raises the anxiety level of the homeowner rather than giving him piece of mind. The need is obvious for a device that will detect the intrusion of someone rather than simply the presence of an intruder. Often motion detectors in combination with window switches are used to accomplish this end. Although this arrangement is adequate for detection of intruders it has one serious limitation. The home can not be secured against intruders unless the windows are closed. It is this problem that the present invention addresses. Many homeowners desire the enjoyment of the fresh breeze that only an open window can provide. In addition to the enjoyment to be derived from an open window, there can also be significant savings in cooling cost during certain parts of the year. With today's utility cost the window mounted motion detector can be of substantial benefit to low and middle income families as well as those who are older and on a limited, fixed income. The invention as described herein will allow the homeowner to enjoy both a cool breeze and a secure home.

SUMMARY OF THE INVENTION

The window mounted motion detector comprises essentially a standard motion detector device integrated with a support device for holding a window sash at a certain height. This support device, or sash prop, has the duel purpose of holding the sash and the motion detector in an adjustable position. The height of the sash prop is also adjustable. In the preferred embodiment of the invention the material of choice is standard schedule forty PVC pipe. This material is inexpensive, readily available and allows for adjustment by simply using various lengths of pipe. Other methods, such as telescoping pipes are also considered to be an option. The use of this invention allows the homeowner to detect the mere approach of an intruder to the window. The detector can be aimed in any direction thus providing protection that the homeowner can be confident in without giving up the joy of leaving his windows open.

DETAILED DESCRIPTION OF THE INVENTION

Figure 1:
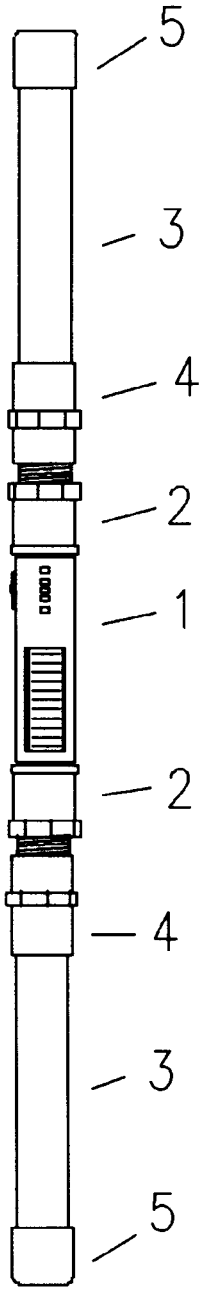
FIG. 1 is a front elevation view of the window-mounted motion detector.
Figure 2:
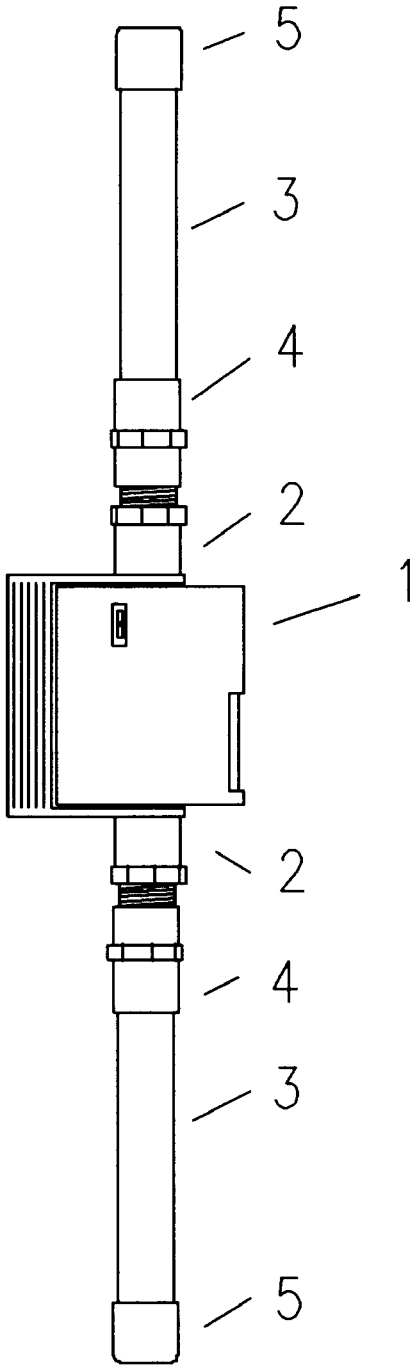
FIG. 2 is a side elevation view of the window-mounted motion detector.
Figure 3:
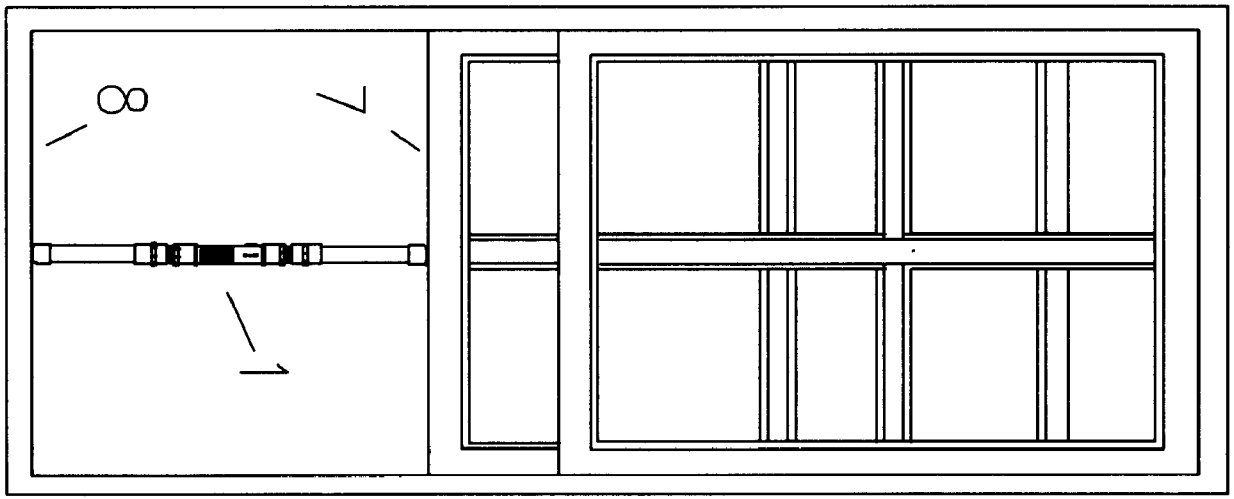
FIG. 3 is a front elevation view of the window-mounted motion detector deployed in a window.

Referring to the drawings it can be seen that a standard, swivel mounted motion detector 1 is affixed at its top and bottom ends with a standard PVC male threaded adapter 2. Extension rods 3 are affixed at one end with a standard PVC female threaded adapter 4. The remaining ends are affixed with PVC caps 5. Caps 5 and female adapters 4 are removable as they are simply inserted into the adapters rather than being glued. This allows for adjustments in height by simply changing extension rods 3. Notches 6 are formed into caps 5. This helps hold the window mounted motion detector in place by accommodating the flange that often is present on the sash of modern metal windows. In addition, these notches 6 allow the window mounted motion detector to be used in open doorways as well as windows in that the notches secure the ends of caps 5 to the door casing and the edge of the door.

Referring to figure three it can be seen that the window mounted motion detector is installed between the window sash 7 and the windowsill 8. The window mounted motion detector serves the duel purpose of holding the window at the desired opening and detecting any movement occurring around the window. The motion detector 1 can be adjusted to detect movement toward the window from any direction. This allows the occupant to enjoy an open window without sacrificing security.

I claim:

1. A window-mounted motion detector for use in a window having a sash and a sill, said window-mounted motion detector comprising a motion detector unit, said motion detector unit having an upper end and a lower end, said window-mounted motion detector further comprising an upper support rod, said upper support rod being connected to said upper end of said motion detector unit, and a lower support rod, said lower support rod being connected to said lower end of said motion detector unit, said upper support rod further comprising an upper end and a lower end, said lower end of said upper support rod being connected to said upper end of said motion detector unit, said upper end of said upper support rod being in contact with said sash of said window, said lower support rod further comprising an upper end and a lower end, said upper end of said lower support rod being connected to said lower end of said motion detector unit, said lower end of said lower support rod being in contact with said sill of said window, said window-mounted motion detector being positioned vertically and in the same plane as said sash so as to support said sash and fix said motion detector unit in the opening in said window.

2. A window-mounted motion detector as recited in claim 1, wherein said support rods comprise a length of PVC pipe, a PVC cap, a PVC female threaded adapter and a PVC male threaded adapter, said length of pipe having an inner and an outer end, said outer end being inserted into said cap, said inner end being inserted into said male threaded adapter, said male threaded adapter being screwed into said female threaded adapter.

3. A window-mounted motion detector as recited in claim 1, wherein said upper end of said upper support rod and said lower end of said lower support rod further comprises a notch cut parallel to said window sash.

4. A motion detector mount for mounting a motion detector in a window, said window having a sash and a sill, said motion detector mount further comprising a motion detector swivel mount case, said motion detector swivel mount case having an upper end and a lower end, said motion detector mount further comprising an upper support rod, said upper support rod being connected to said upper end of said swivel mount case, and a lower support rod, said lower support rod being connected to said lower end of said swivel mount case, said upper support rod further comprising an upper end and a lower end, said lower end of said upper support rod being connected to said upper end of said swivel mount case, said upper end of said upper support rod being in contact with said sash of said window, said lower support rod further comprising an upper end and a lower end, said upper end of said lower support rod being connected to said lower end of said swivel mount case, said lower end of said lower support rod being in contact with said sill of said window, said motion detector mount being positioned vertically and in the same plane as said sash so as to support said sash and fix said motion detector unit in the opening in said window.

5. A motion detector mount as recited in claim 4, wherein said support rods comprise a length of PVC pipe, a PVC cap, a PVC female threaded adapter and a PVC male threaded adapter, said length of pipe having an inner and an outer end, said outer end being inserted into said cap, said inner end being inserted into said male threaded adapter, said male threaded adapter being screwed into said female threaded adapter.

6. A motion detector mount as recited in claim 4, wherein said upper end of said upper support rod and said lower end of said lower support rod further comprises a notch cut parallel to said window sash.

* * * * *